US007762304B2

(12) United States Patent
La Marca et al.

(10) Patent No.: US 7,762,304 B2
(45) Date of Patent: Jul. 27, 2010

(54) DEVICE FOR DETECTING AN OBSTACLE AND LIMITING THE FORCE OF AN APRON IN A GOODS-HANDLING DOOR

(75) Inventors: Antonello La Marca, Corbas (FR); Bernard Simon, Caluire-et-Cuire (FR); Anne-Sophie Panseri, legal representative, Montanay (FR); Romain Simon, legal representative, Lyons (FR)

(73) Assignee: Maviflex, Decines (FR)

( * ) Notice: Subject to any disclaimer, the term of this patent is extended or adjusted under 35 U.S.C. 154(b) by 190 days.

(21) Appl. No.: 11/887,078

(22) PCT Filed: Mar. 24, 2006

(86) PCT No.: PCT/FR2006/000653

§ 371 (c)(1),
(2), (4) Date: Oct. 31, 2007

(87) PCT Pub. No.: WO2006/100394

PCT Pub. Date: Sep. 28, 2006

(65) Prior Publication Data

US 2009/0101292 A1 Apr. 23, 2009

Related U.S. Application Data

(60) Provisional application No. 60/737,395, filed on Nov. 17, 2005.

(30) Foreign Application Priority Data

Mar. 25, 2005 (FR) ..... 05 02982

(51) Int. Cl.
*E05F 15/20* (2006.01)
*E06B 9/56* (2006.01)
*A47G 5/02* (2006.01)

(52) U.S. Cl. ..... 160/8; 160/1; 160/267.1

(58) Field of Classification Search ..... 160/1, 160/8, 3, 4, 310, 311, 291; 242/534, 563, 242/912, 413.3, 418.1, 371, 374, 390.2, 390.3, 242/390.8, 390.9

See application file for complete search history.

(56) References Cited

U.S. PATENT DOCUMENTS 2,900,521 A * 8/1959 Eames ..... 187/317
3,305,873 A * 2/1967 Mourier ..... 346/112

(Continued)

FOREIGN PATENT DOCUMENTS

EP 0 557 589 A1 9/1993

(Continued)

*Primary Examiner*—Katherine W Mitchell
*Assistant Examiner*—Jaime F Cardenas-Garcia
(74) *Attorney, Agent, or Firm*—Young & Thompson

(57) ABSTRACT

The invention relates to a device for detecting an obstacle and limiting the force from the primary edge or sill nosing (10) of a flexible apron or curtain (5) in a goods-handling door (1) when the latter comes into contact with an obstacle (14) as it is being closed. The inventive device comprises safety cells (21, 22) which are positioned and fixed close to each guiding device (8) such as to emit a beam F that is directed along a vertical axis outside of the guide (15) so that the beam is interrupted upon deformation of the flexible curtain or apron (5).

7 Claims, 6 Drawing Sheets

U.S. PATENT DOCUMENTS

| | | | | | |
|---|---|---|---|---|---|
| 4,621,452 | A * | 11/1986 | Deeg | 49/28 |
| 4,866,881 | A * | 9/1989 | Morrow et al. | 49/25 |
| 4,914,859 | A * | 4/1990 | Gionet et al. | 49/25 |
| 4,996,541 | A * | 2/1991 | Mori et al. | 347/264 |
| 5,207,256 | A * | 5/1993 | Kraeutler | 160/84.02 |
| 5,399,851 | A * | 3/1995 | Strand | 250/222.1 |
| 5,706,875 | A * | 1/1998 | Simon | 160/8 |
| 6,145,572 | A * | 11/2000 | Kraeutler | 160/310 |
| 6,218,940 | B1 * | 4/2001 | Rejc et al. | 340/556 |
| 6,243,006 | B1 * | 6/2001 | Rejc et al. | 340/436 |
| 6,304,178 | B1 * | 10/2001 | Hayashida | 340/545.1 |
| 6,470,950 | B2 * | 10/2002 | Shimizu | 160/121.1 |
| 6,481,487 | B2 * | 11/2002 | Simon | 160/84.06 |
| 6,598,648 | B1 * | 7/2003 | Schulte | 160/1 |
| 6,631,788 | B2 * | 10/2003 | Shikai et al. | 187/316 |
| 6,729,378 | B2 * | 5/2004 | Simon et al. | 160/84.06 |
| 6,782,660 | B2 * | 8/2004 | Takada et al. | 49/25 |
| 6,874,199 | B2 * | 4/2005 | Simon et al. | 16/96 R |
| 6,962,239 | B2 * | 11/2005 | Shikai et al. | 187/316 |
| 6,964,289 | B2 * | 11/2005 | Schulte | 160/1 |
| 7,093,692 | B2 * | 8/2006 | Koura | 187/316 |
| 7,151,450 | B2 * | 12/2006 | Beggs et al. | 340/545.1 |
| 7,342,368 | B2 * | 3/2008 | Roman | 318/285 |
| 2001/0013762 | A1 * | 8/2001 | Roman | 318/282 |
| 2002/0124972 | A1 * | 9/2002 | Simon | 160/84.06 |
| 2002/0125077 | A1 * | 9/2002 | Shikai et al. | 187/317 |
| 2003/0071590 | A1 * | 4/2003 | Roman | 318/282 |
| 2003/0089461 | A1 * | 5/2003 | Dondlinger | 160/84.06 |
| 2003/0155082 | A1 * | 8/2003 | Simon et al. | 160/84.06 |
| 2003/0173041 | A1 * | 9/2003 | Simon et al. | 160/267.1 |
| 2003/0205341 | A1 * | 11/2003 | Simon et al. | 160/267.1 |
| 2003/0209391 | A1 * | 11/2003 | Shikai et al. | 187/317 |
| 2003/0221792 | A1 * | 12/2003 | Schulte | 160/1 |
| 2005/0269045 | A1 * | 12/2005 | Rejc | 160/264 |
| 2006/0054284 | A1 | 3/2006 | Coenraets | |
| 2008/0264578 | A1 * | 10/2008 | Goodman et al. | 160/202 |
| 2009/0120595 | A1 * | 5/2009 | Goodman et al. | 160/371 |

FOREIGN PATENT DOCUMENTS

| | | | |
|---|---|---|---|
| EP | 1 233 138 | A1 | 8/2002 |
| FR | 2931866 | * | 12/2009 |
| FR | 2931866 | A1 * | 12/2009 |
| JP | 4-357291 | | 12/1992 |
| JP | 2003-120154 | | 4/2003 |

* cited by examiner

DEVICE FOR DETECTING AN OBSTACLE AND LIMITING THE FORCE OF AN APRON IN A GOODS-HANDLING DOOR

DESCRIPTION OF THE RELATED ART

The present invention relates to a device for detecting an obstacle and limiting the force of the primary edge or closure sill bar of a winding or folding goods-handling door when an obstacle preventing the correct functioning of the flexible curtain or apron is detected.

Devices for detecting an obstacle of an automatic goods-handling door with vertical movement of the flexible curtain or apron can be categorized according to three operational modes, as follows:

- Detection devices with non-material barriers fixed to the vertical uprights of the goods-handling door.
- Detection devices with electrical or pneumatic feelers disposed on the primary closing edge of the flexible curtain or apron of the goods-handling door. These devices are designed to actuate the raising of the door when the latter encounters an obstacle during its descent. The devices are housed under the sill bar forming the primary edge of the goods-handling door. The devices are constituted by a pressure feeler system applied continuously over the entire width of the sill bar.
- Devices for detecting loops formed by the fabric of the apron when it is blocked whilst descending.

From the patent EP 765 990 held by the Applicant, there is also known a device for detecting an obstacle for a goods-handling door comprising detection means which are constituted by at least one strap having a substantially curved profile and disposed perpendicularly and in the vicinity of the winding shaft. The strap is connected on the one hand to a position switch and on the other hand to a fixed strip or to a face of a cover integral with the lateral uprights of the goods-handling door.

From the patent EP 843 070 in the Applicant's name, there is known a device for detecting obstacles comprising an opto-electronic detection cell disposed on the one hand close to the winding shaft of the apron and on the other hand outside of the winding zone of said apron.

It is observed that the means of detecting an obstacle described above are generally provided close to the winding shaft of the apron of the goods-handling door. This position of the detection means is not suitable because it is too far from the zone of contact of the sill bar with the obstacle to be able to react quickly. In fact, it is imperative, in order that the detection means are triggered, that a slack section of the apron deforms sufficiently quickly in order to activate said detection means.

SUMMARY OF THE INVENTION

The purpose of the device for detecting an obstacle and limiting force according to the present invention is to dispose detection means on the one hand as close as possible to the potential contact zone between the primary edge or the sill bar and the obstacle and, on the other hand, as far as possible from the winding shaft of the apron of the goods-handling door in order to be able to react as quickly as possible.

The device for detecting an obstacle and limiting force according to the present invention is intended for goods-handling doors comprising means of driving said flexible curtain or apron, opposing vertical uprights each integral with a guiding device comprising two opposing slides in order to constitute a guide on each upright and over the entire height of the latter.

The device for detecting an obstacle and limiting force according to the present invention comprises safety cells positioned and fixed in the proximity of each guiding device in such a way as to emit at least one beam F directed in a vertical direction, which is provided outside of the guide, in order that said beam is interrupted during the deformation of the flexible curtain or apron.

The device for detecting an obstacle and limiting force according to the present invention comprises safety cells where the beam F emitted by the latter is directed on the one hand in a vertical plane parallel with the flexible curtain or apron and on the other hand in an inclined direction intersecting the center of the goods-handling door.

The device for detecting an obstacle and limiting force according to the present invention comprises safety cells which are fitted in the upper and lower parts respectively of the goods-handling door in order to emit in a vertical direction a beam F of light, infrared, microwave or any other type of radiation.

The device for detecting an obstacle and limiting force according to the present invention comprises flexible elements attached to the flexible curtain and which are designed to deform when said curtain encounters an obstacle, during its descent, in order to interrupt the beam F emitted by the safety cells.

The device for detecting an obstacle and limiting force according to the present invention comprises flexible elements each comprising a first end which is fixed to the sill bar, whilst the other end is integral with said curtain above and at a certain distance from said bar.

The device for detecting an obstacle and limiting force according to the present invention comprises slides which are constituted by taut and flexible straps at least one of which comprises a series of deformation zones disposed at regular intervals over the entire height of said strap.

The device for detecting an obstacle and limiting force according to the present invention comprises slides which are constituted by semi-rigid or rigid strips at least one of which comprises a series of deformation zones disposed at regular intervals over the entire height of said strip.

The device for detecting an obstacle and limiting force according to the present invention comprises straps in which each deformation zone is produced by the intermediary of cylindrical members fixed in the wall of the corresponding upright and around which said strap is positioned.

The device for detecting an obstacle and limiting force according to the present invention comprises strips in which each deformation zone is produced by the intermediary of a notch formed in the width of said strip.

BRIEF DESCRIPTION OF THE DRAWINGS

The following description given with reference to the appended drawings, given as non-limiting examples, will allow a better understanding of the invention, the features it exhibits and the advantages it is likely to procure.

DETAILED DESCRIPTION OF THE PREFERRED EMBODIMENTS

Figure 1:
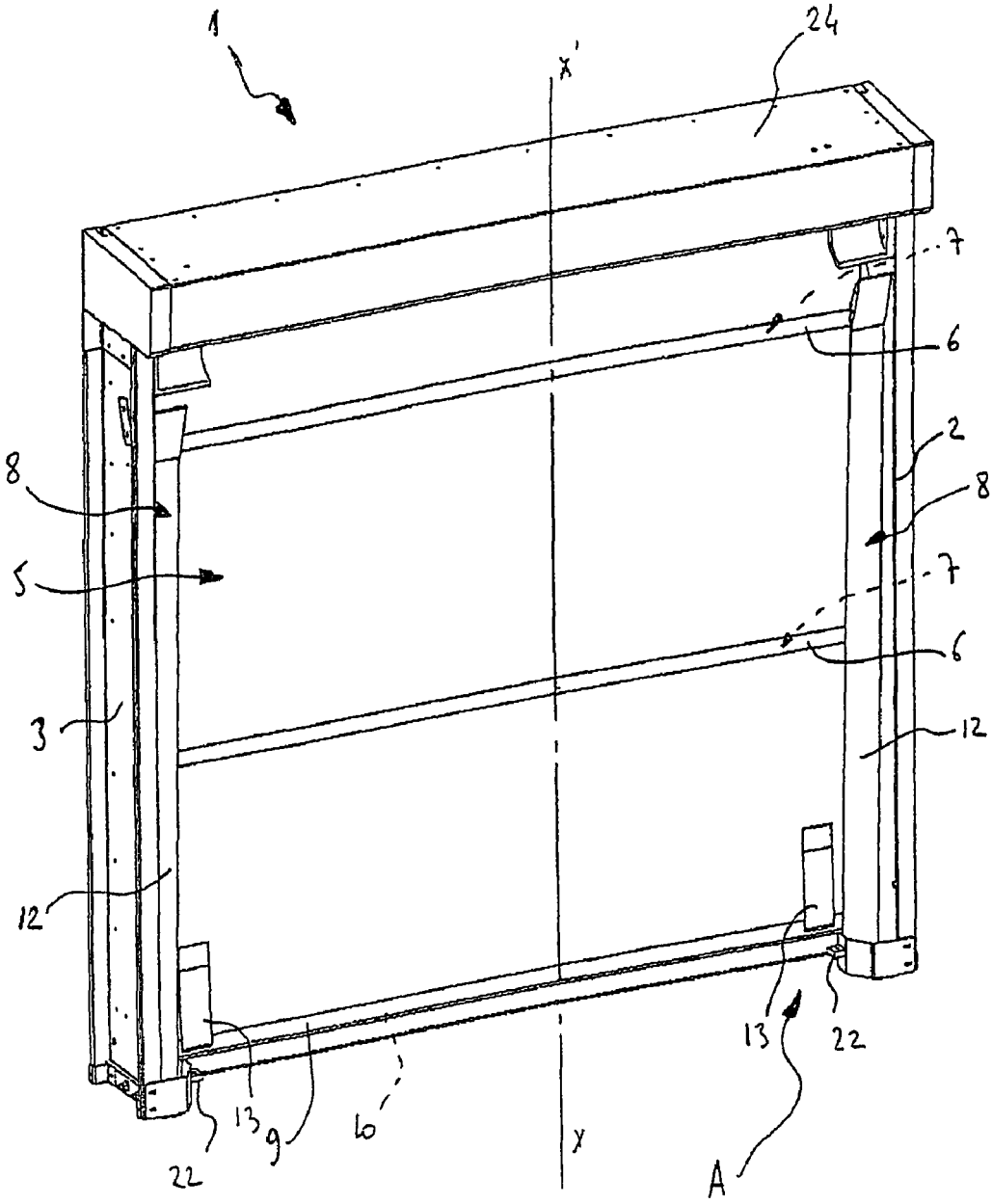
FIG. 1 is a perspective view showing a goods-handling door equipped with the device for detecting an obstacle and limiting the force of the primary edge or closure sill bar of a goods-handling door according to the present invention.

FIG. 1 shows a goods-handling door 1 comprising two lateral uprights 2 and 3 which are generally fixed against the vertical walls of an opening to be closed.

The opposing and vertical uprights 2 and 3 are connected to each other, in the upper part of the goods-handling door 1, by a winding shaft or drum 4 allowing the movement of a flexible curtain or apron 5 between an open position and a closed position.

It is observed that the flexible curtain or apron 5 can comprise, for example, sleeves 6 into which are inserted strengthening horizontal cross-pieces 7 whose ends cooperate with a guiding device 8, forming a guide, provided on each upright 2 and 3.

The flexible curtain or apron 5 comprises at its free end a primary closing edge which is constituted by a sleeve 9 into which is inserted a sill bar 10.

Each guiding device 8 can be produced by two opposed slides which are constituted, for example, either by two taut and flexible straps, or by two semi-rigid or rigid strips disposed facing each other in order to constitute on each upright 2 and 3, and over the entire height of the latter, a guide 15 for guiding the curtain 5, the horizontal cross-pieces 7 and the sill bar 10.

The goods-handling door 1 comprises a guiding device 8 whose opposed slides are constituted by two taut and flexible straps 11, 12 disposed facing each other in order to constituted on each upright 2, 3, and over the entire height of the latter, a guide 15 for guiding the flexible curtain 5, the horizontal cross-pieces 7 and the sill bar 10.

The flexible curtain 5 comprises on its face, in the vicinity of each guiding device 8 and outside of the guides 15, a flexible element 13 one of whose ends is fixed to the sleeve 9, cooperating with the sill bar 10, whilst the other end is integral with said curtain above and at a certain distance from said sleeve 9.

Each flexible element 13 is attached and fixed either on one, or on both faces of the flexible curtain 5 according to the use of the goods-handling door 1.

Each element 13 is fixed either by high-frequency welding or by sewing on the corresponding face of the flexible curtain 5 of the goods-handling door 1.

The goods-handling door 1 comprises on each upright 2, 3 a device for detecting an obstacle and limiting force A which is constituted by safety cells 21, 22 fixed in the upper and lower parts respectively of the goods-handling door 1 in order to emit, in a vertical direction, a beam F of light, infrared, ultraviolet, microwave or any other type of radiation.

The emitting safety cell 21 is fixed, for example, on the side of the second strap 12 of the guiding device 8 of each upright 2, 3, on a plate 23 integral with the protective cover 24 of the winding drum 4.

The receiving safety cell 22 is fixed, on the side of the second strap 12 of the guiding device 8 of each upright 2, 3 and at ground level of the goods-handling door 1 in the vicinity of the tensioning member 25 of said strap 12.

The safety cells 21, 22 make it possible to emit a beam F which is directed in a vertical direction and positioned in the vicinity of the outer edge of the second strap 12 of each guiding device 8.

The position of the cells 21, 22 in the vicinity of the outer edge of the second strap 12 makes it possible to avoid any triggering of the device for detecting an obstacle and limiting force A when the flexible curtain or apron 5 is deformed by a lateral thrust due to wind or to a pressure drop.

The beam F emitted by the safety cells 21, 22 is provided on the outside of the guide 15 and therefore outside of the zone of movement of the flexible curtain 5.

For this purpose, in normal operation and in the absence of an obstacle 14, no part of the curtain 5 passes in front of the safety cells 21, 22 such that there is no risk of the beam F being interrupted.

Another device for detecting and limiting force A can be provided on the side of the first straps 11 of each guiding device 8.

Figure 2:
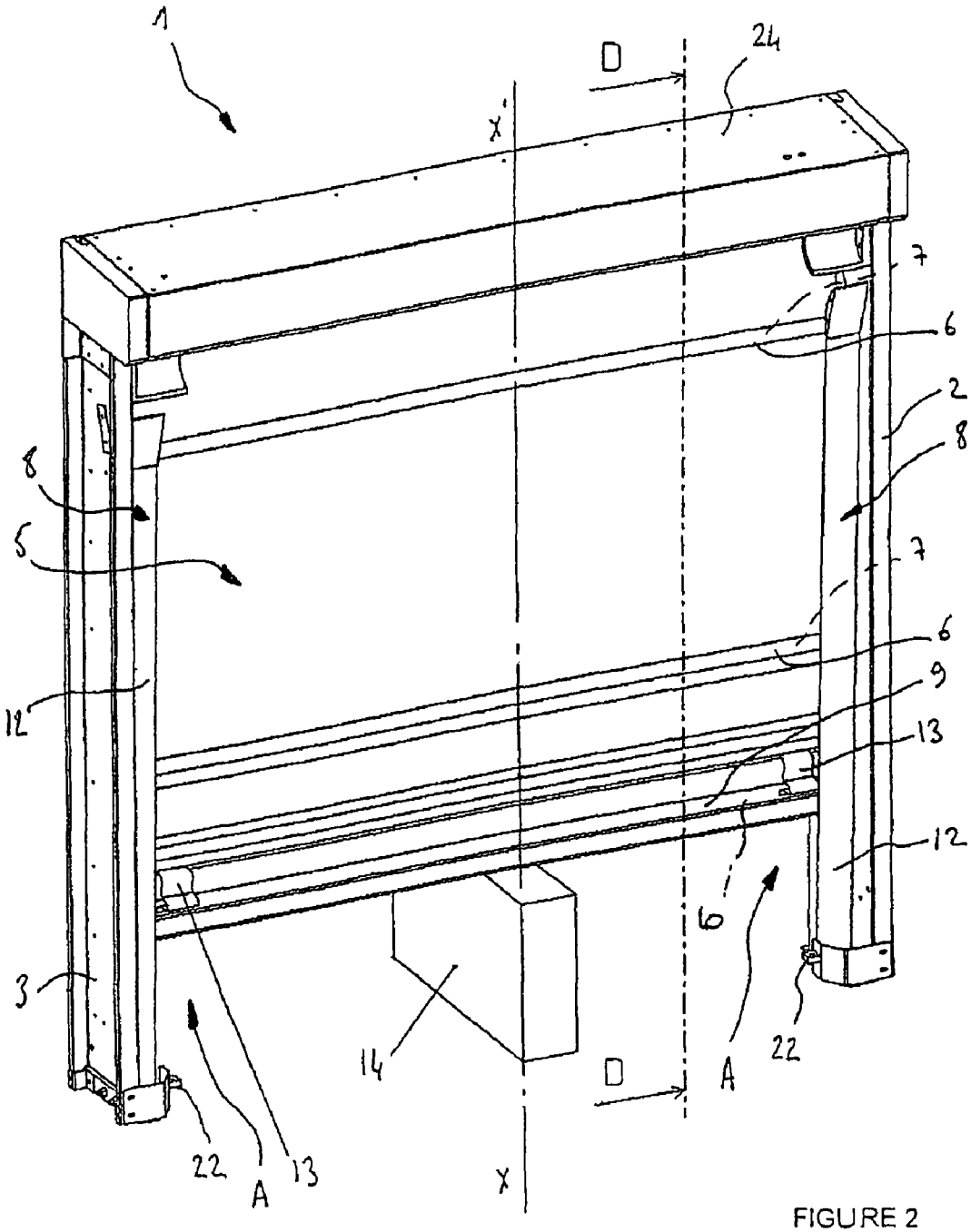
FIG. 2 is a perspective view showing the flexible curtain or apron of the goods-handling door encountering an obstacle during its descent.
Figure 3:
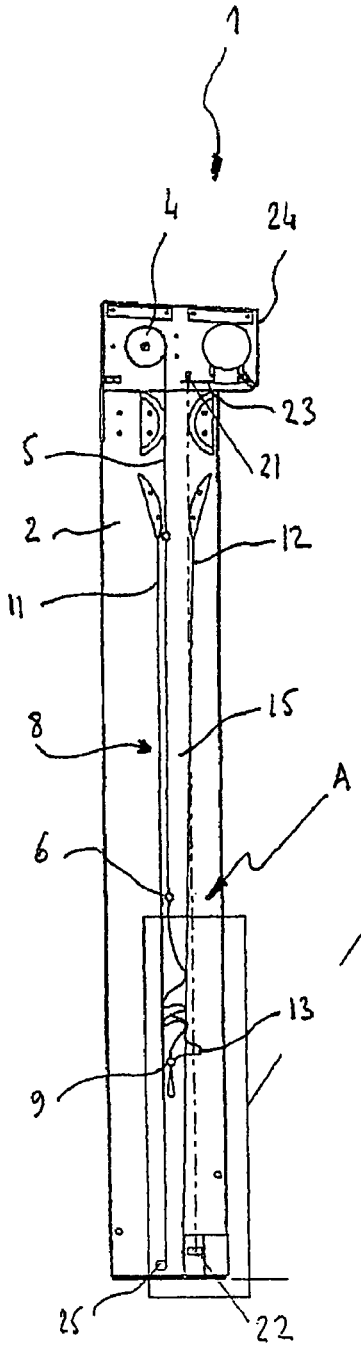
FIGS. 3 and 4 are views showing the functioning of a device for detecting an obstacle and limiting the force of the primary edge or closure sill bar of a goods-handling door according to the present invention.
Figure 4:
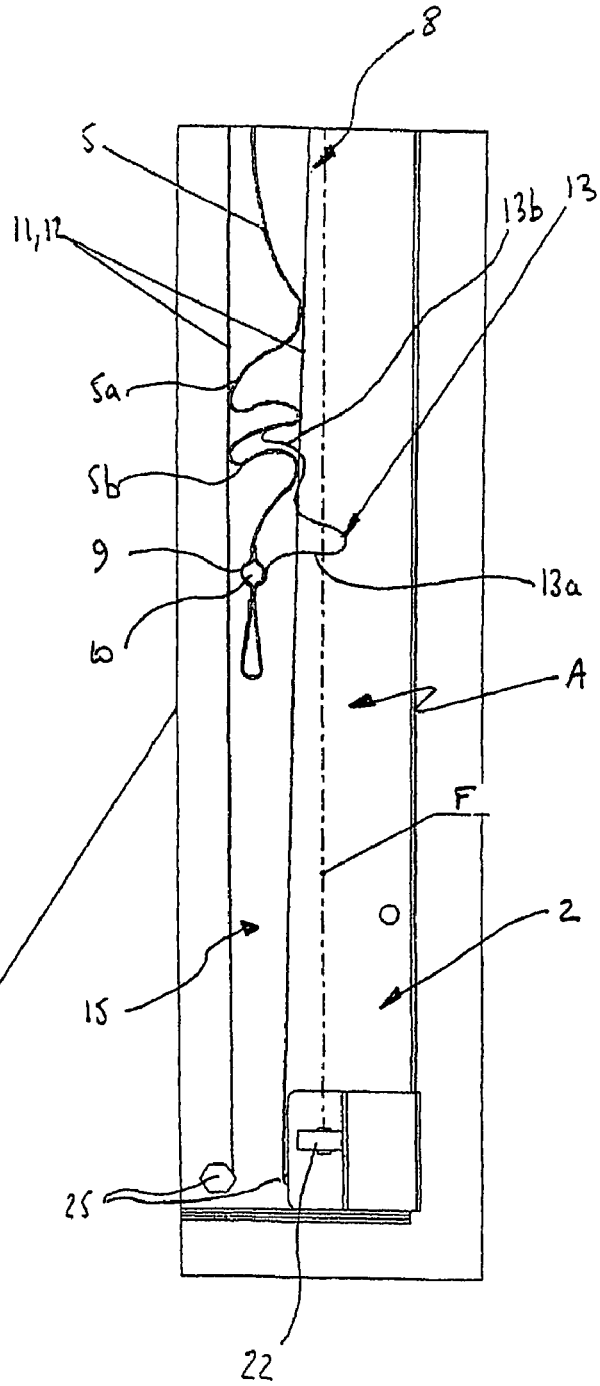

The functioning of the device for detecting an obstacle and for limiting force A provided on each upright 2, 3 of the goods-handling door 1 when the flexible curtain 5 encounters an obstacle 14 whilst it is closing is shown in FIGS. 2 to 4.

Thus, when the primary closing edge or sill bar 10 encounters an obstacle 14 during the closing of the flexible curtain 5, the winding drum or shaft 4 continues its rotation creating over the width a deformation of the flexible curtain 5 constituted, for example, by one or more slack sections or folds 5*a*, 5*b*.

It is noted that when the slack sections or folds 5*a*, 5*b* of the flexible curtain 5 pass in front of the beam F emitted by the safety cells 21, 22, the latter is interrupted, immediately causing on the one hand the stopping of the rotation of the winding drum or shaft 4 and on the other hand the reversal of the direction of rotation of said drum to allow the raising of the flexible curtain 5.

When the flexible curtain 5 comprises flexible elements 13 on one of its faces and the primary closing edge or sill bar 10 encounters an obstacle 14 whilst it is closing, it is observed, because of the continuous rotation of the winding drum or shaft 4 that, on the one hand, the flexible curtain 5 deforms over its width and in the guides 15 of each upright 2, 3 creating one or more slack sections or folds 5*a*, 5*b* and, on the other hand, that the flexible elements 13 fold also forming folds 13*a*, 13*b* that are independent of those of the curtain.

The fact that the flexible elements 13 are not retained inside each guide 15, guiding at each end of the flexible curtain 5, the latter deform more rapidly than said curtain when the primary closing edge or sill bar 10 encounters an obstacle 14 whilst it is closing.

This deformation of the flexible elements 13 allows the folds 13*a*, 13*b* to pass in front of the beam F emitted by the safety cells 21, 22 and to interrupt the latter immediately causing the stopping of the rotation of the winding drum or shaft 4. In order to do this it is necessary that the flexible elements 13 are placed on the flexible curtain 5 at the level of the path of the beam F emitted by the cells 21, 22.

In this case, the device for detecting an obstacle and limiting force A constituted by flexible elements 13 and safety cells 21, 22 fixed in the upper and lower part respectively of the goods-handling door 1.

Figures 5, 6, 7:
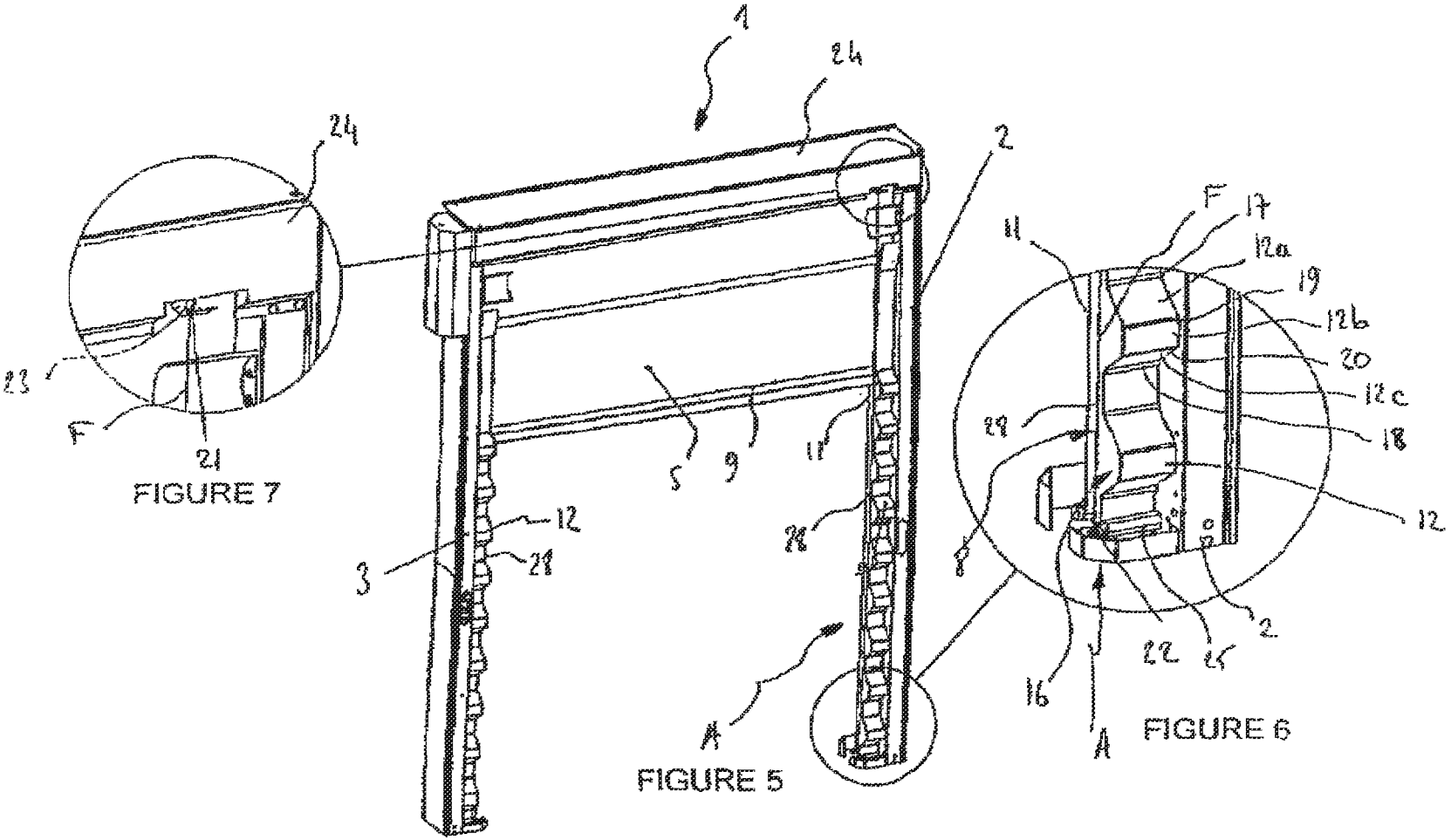
FIGS. 5 through 9 are views showing a first variant of the slides forming the guiding device of the goods-handling door and of the device for detecting an obstacle and limiting force according to the present invention.

A first variant of the slides forming the guiding device of the goods-handling door 1 is shown in FIGS. 5 to 7.

The goods-handling door 1 comprises a guiding device 8 whose opposed slides are constituted by two taut and flexible straps 11, 12 disposed facing each other in order to constitute on each upright 2, 3 and over the entire height of the latter, a guide 15 for guiding the flexible curtain 5, the horizontal cross-pieces 7 and the sill bar 10.

The second strap 12 of the guiding device 8 provided on each upright 2, 3 comprises over its height a device for detecting an obstacle and limiting force A which is constituted firstly by a series of deformation zones 16 disposed at regular intervals over the entire height of said strap. Each deformation zone 16 is produced by the intermediary of cylindrical members 17, 18, 19 and 20 fixed in the wall of the corresponding upright 2, 3 and around which said strap is positioned.

Thus, for each deformation zone 16, the first cylindrical members 17 and 18 are on the one hand spaced by a first vertical distance d from each other and on the other hand positioned in a common vertical axis which is contained in the plane containing the second strap 12 before and after the deformation zone 16.

The second cylindrical members 19 and 20 are on the one hand spaced by a second vertical distance d' from each other and on the other hand positioned on a common vertical axis which is contained in a plane parallel with and distant from the vertical plane containing the first cylindrical members 17 and 18.

The second distance d' provided between the cylindrical members 19 and 20 has a dimension smaller than the first distance d separating the cylindrical members 17 and 18.

Because of this, the second strap 12 is positioned around the cylindrical members 17 to 20 such that each deformation zone 16 is constituted between the cylindrical members 17 and 19 by a first inclined section 12*a* extending between the cylindrical members 19 and 20 by a vertical section 12*b* and then continues between the cylindrical members 20 and 18 by another inclined section 12*c*.

The device for detecting an obstacle and limiting force A is secondly constituted by safety cells 21, 22 fixed in the upper and lower part respectively of the goods-handling door 1 in order to emit, in a vertical direction, a beam F of light, infrared, ultraviolet or any other kind of radiation.

The emitting safety cell 21 is fixed, on the side of the second strap 12 of the guiding device 8 of each upright 2, 3, on a plate 23 integral with the protective cover 24 of the winding drum 4.

The receiving safety cell 22 is fixed, on the side of the second strap 12 of the guiding device 8 of each upright 2, 3 at ground level of the goods-handling door 1 in the vicinity of the tensioning member 25 of said strap 12.

The safety cells 21, 22 make it possible to emit a beam F which is directed in a vertical direction and positioned in the vicinity of the outer edge of the second strap 12 of each guiding device 8.

The beam F emitted by the safety cells 21, 22 is provided outside of the guide 15 and therefore outside of the movement zone of the flexible curtain 5.

For this purpose, in normal operation and in the absence of an, obstacle, no part of the curtain 5 passes in front of the safety cells 21, 22 such that there is no risk of the beam F being interrupted.

Figures 8, 9:
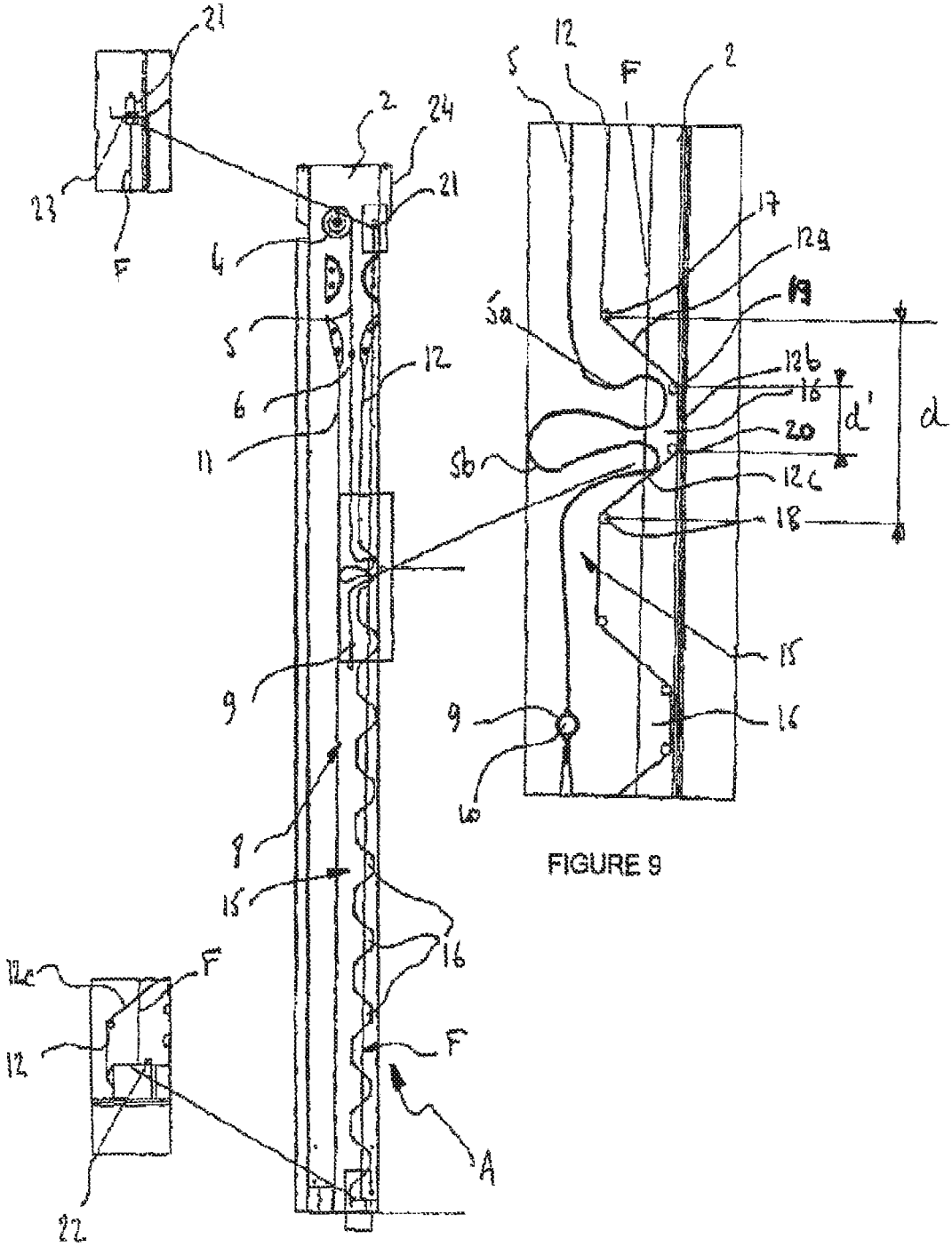

FIGS. 8 to 9 show the functioning of the device for detecting an obstacle and limiting force A provided on each upright 2, 3 of the goods-handling door 1 when the flexible curtain 5 encounters an obstacle 14 whilst it is closing.

Thus, when the primary closing edge or sill bar 10 encounters an obstacle 14 during the closing of the flexible curtain 5, the winding drum or shaft 4 continues its rotation creating in the guides 15 of each upright 2, 3 one or more slack sections or folds of the flexible curtain 5 likely to penetrate the closest deformation zone 16, that is to say that which is located just above the blockage level during the descent of the curtain.

When one or more slack sections of the flexible curtain 5 penetrate inside a deformation zone 16 formed in the guide 15 of each upright 2, 3, the latter pass in front of the beam F emitted by the safety cells 21, 22 interrupting said beam and immediately causing on the one hand the stopping of the rotation of the winding drum or shaft 4 and on the other hand the reversal of the direction of rotation of said drum in order to allow the raising of the flexible curtain 5.

Figure 10:
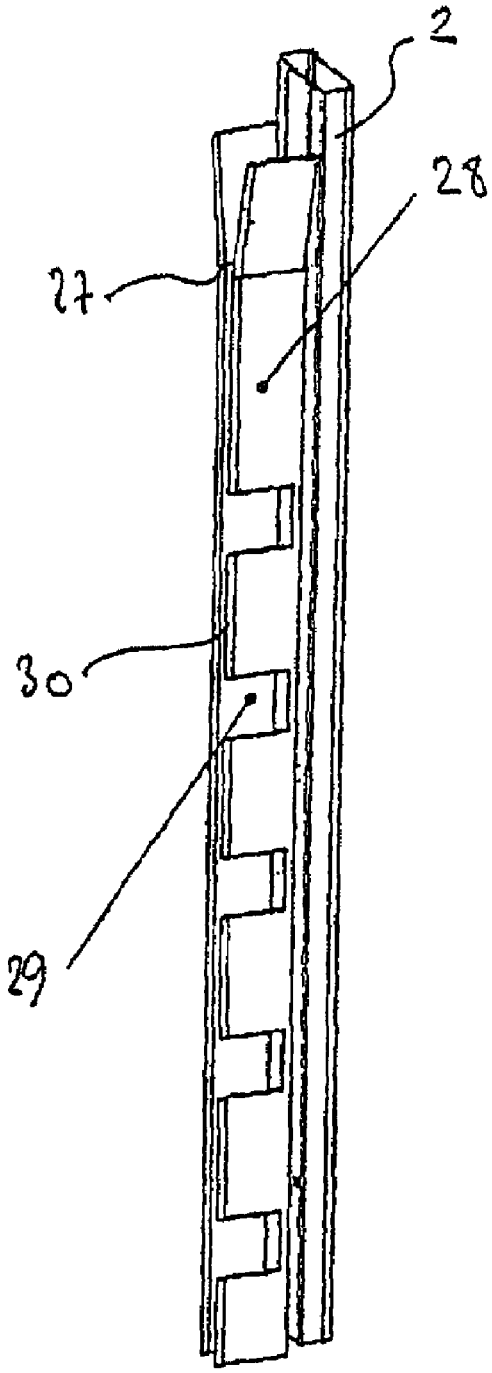
FIG. 10 is a view showing a second variant of the slides forming the guiding device of the goods-handling door according to the present invention.

FIG. 10 shows a variant of the guiding device 8 whose opposite slides are constituted, for example, by two semi-rigid or rigid strips 27, 28 disposed facing each other in order to constitute on each upright 2 and 3, and over the entire height of the latter, a guide 15 for guiding the curtain 5, the horizontal cross-pieces 7 and the sill bar 10.

The second strip 28 of the guiding device 8 provided on each upright 2, 3 comprises over its height a device for detecting an obstacle and limiting force A which is constituted firstly by a series of deformation zones 16 disposed at regular intervals over the entire height of said strip.

Each deformation zone 16 is produced by the intermediary of a notch 29 formed in the width of the second strip 28 and opening on the side of the outer edge 30 of the strip.

The device for detecting an obstacle and limiting force A is secondly constituted by safety cells 21, 22 fixed in the upper and lower part respectively of the goods-handling door 1 in order to emit in a vertical direction a beam F of light, infrared, ultraviolet, microwave or any other type of radiation.

The safety cells 21, 22 make it possible to emit a beam F which is directed in a vertical direction and positioned in the vicinity of the outer edge 30 of the second strip 28 of each guiding device 8.

The functioning of the device for detecting an obstacle and limiting force A with a guiding device 8 whose opposite slides are constituted by two semi-rigid or rigid strips 27, 28, at least one of which comprises notches 29, is identical to that described in FIGS. 8 and 9.

As a variant, when one of the strips 27, 28 comprises over its height a series of notches 29, provision can be made for the beam F emitted by the safety cells 21, 22 to be disposed in front of said strip in order to pass, for example, in the middle and in front of each notch 29.

As a variant, the opposite slides of the guiding device 8 can be constituted on each upright 2, 3 by semi-rigid strips 27, 28 which are made either from extruded plastic or from extruded rubber and at least one of said strips comprises an edge which is shaped in order to determine one or more deformation zones 16 such as described previously for the straps 11, 12.

Also as a variant, the opposite slides of the guiding device 8 can be constituted on each upright 2, 3 by rigid strips 27, 28 which are made from steel, or from wood, or from machined plastic, or from a composite material and at least one of said strips comprises an edge which is shaped in order to determine one or more deformation zones 16.

It is observed that the beam F emitted by the safety cells 21, 22 can assume a vertical direction which can either be in a plane parallel with the one containing the outer edge of the corresponding slide or in an inclined plane intersecting the one containing the outer edge of the corresponding slide.

It is also noted that the beam F emitted by the safety cells 21, 22 can be directed one the one hand in a vertical plane parallel with the flexible curtain or apron 5 and on the other hand in an inclined direction intersecting the center xx' of the goods-handling door 1.

It is noted that the device for detecting an obstacle and limiting force A described in the preceding FIGS. 1 to 10 also functions for folding goods-handling doors 1.

It must moreover be understood that the preceding description has been given only by way of example and that it in no way limits the scope of the invention which is not departed from by replacing the details of embodiment described with any other equivalent.

The invention claimed is:

1. A device for detecting an obstacle and limiting the force of a primary edge or closure sill bar (10) of a flexible apron or curtain (5) of a goods-handling door (1) upon the event of the goods-handling door (1) encountering the obstacle (14) while the goods-handling door (1) is closing, said goods-handling door (1) including means of driving said flexible curtain or apron (5), and two vertical uprights (2, 3) arranged to oppose each other, each of said vertical uprights connected to a guiding device (8) with two opposing slides (11, 12), and each guiding device (8) constituting a guide (15) on and over an entire height of each respective upright, the device comprising:

elements (13) attached to the flexible curtain or apron (5); and safety cells (21, 22) positioned and fixed in a proximity of each guiding device (8) and configured to emit at least one beam (F) outside of the guide (15) and in a vertical direction, wherein said elements (13) are flexible and configured to deform in order to interrupt the beam (F) emitted by the safety cells (21, 22) when said flexible apron or curtain encounters the obstacle (14) during the descent, and wherein the safety cells are configured such that, when said curtain or apron (5) encounters the obstacle during the closing, said at least one beam (F) is interrupted by a deformation of the flexible curtain or apron (5), or is interrupted by a deformation of said elements (13) attached to the flexible curtain (5).

2. The device as claimed in claim 1, wherein the beam (F) emitted by the safety cells (21, 22) is directed in a vertical plane parallel with the flexible curtain or apron (5).

3. The device as claimed in claim 1, wherein the beam (F) emitted by the safety cells (21, 22) is directed in a vertical direction and parallel to the plane containing an outer edge of the corresponding slide.

4. The device as claimed in claim 1, wherein the beam (F) emitted by the safety cells (21, 22) is directed in a vertical direction and in an inclined plane intersecting a plane containing an outer edge of the corresponding slide.

5. The device as claimed in claim 1, wherein first and second safety cells (21, 22) are respectively fitted in upper and lower parts of the goods-handling door (1) such that said first and second safety cells (21, 22) emit the at least one beam (F) in a vertical direction, and wherein the at least one beam (F) comprises a radiation of any of light, infrared radiation, and ultraviolet radiation.

6. The device as claimed in claim 1, wherein said elements (13) attached to the flexible curtain (5) are flexible and configured to deform in order to interrupt the beam (F) emitted by the safety cells (21, 22) when said flexible apron or curtain encounters the obstacle (14) during the descent.

7. The device as claimed in claim 1, wherein each of said elements (13) comprises a first end fixed to the sill bar (10), and a second end integral with the flexible apron or curtain (5) above and spaced by a distance from said sill bar (10).

* * * * *